US010363672B2

(12) United States Patent
Kerulis et al.

(10) Patent No.: US 10,363,672 B2
(45) Date of Patent: Jul. 30, 2019

(54) RESILIENT CUTLERY HANDLE

(71) Applicant: Corelle Brands Holdings Inc., Rosemont, IL (US)

(72) Inventors: Pat Kerulis, Bartlett, IL (US); Karl Ludeman, Chicago, IL (US); Randy Soibel, Chicago, IL (US); Bing Zhong, Schaumburg, IL (US)

(73) Assignee: Corelle Brands Holdings Inc., Rosemont, IL (US)

( * ) Notice: Subject to any disclaimer, the term of this patent is extended or adjusted under 35 U.S.C. 154(b) by 372 days.

(21) Appl. No.: 14/857,506

(22) Filed: Sep. 17, 2015

(65) Prior Publication Data

US 2016/0256994 A1 Sep. 8, 2016

Related U.S. Application Data

(60) Provisional application No. 62/129,599, filed on Mar. 6, 2015.

(51) Int. Cl.
*B25G 1/10* (2006.01)
*B26B 1/10* (2006.01)
(Continued)

(52) U.S. Cl.
CPC ..... *B26B 3/02* (2013.01); *B25G 1/102* (2013.01); *B26B 1/10* (2013.01); *B26B 3/00* (2013.01)

(58) Field of Classification Search
CPC .... B26B 3/00; B26B 3/02; B26B 3/03; B25G 1/00; B25G 1/02; B25G 1/025; B25G 1/10; B25G 1/102
(Continued)

(56) References Cited

U.S. PATENT DOCUMENTS 1,862,649 A * 6/1932 Amoroso ..... B26B 1/10 30/155
D220,930 S * 6/1971 Arlett ..... D22/118
(Continued)

FOREIGN PATENT DOCUMENTS

CN 204076208 U 1/2015
DE 11201600031 T5 12/2017
(Continued)

OTHER PUBLICATIONS

International Search Report and Written Opinion from PCT Patent Application No. PCT/US2016/013904 dated Apr. 4, 2016, 12 pages, application now published as International Publication No. WO2016/144428 on Sep. 15, 2016.

*Primary Examiner* — Jason Daniel Prone
*Assistant Examiner* — Richard D Crosby, Jr.
(74) *Attorney, Agent, or Firm* — Morgan, Lewis & Bockius LLP

(57) ABSTRACT

A cutlery implement having a blade and resilient handle is disclosed. The blade has a proximal end, an opposed distal end, a cutting edge and a spine. The spine is disposed on a top side of the blade portion and generally opposed to the cutting edge. The cutlery implement also includes a handle coupled to the blade proximate the distal end of the blade. The handle includes an upper handle portion and a lower handle portion. The upper handle portion is disposed at or near the spine of the blade, and the lower handle portion is coupled to the upper handle portion. Either the upper handle portion or the lower handle is formed from a resilient polymer material, and the other is formed of a generally rigid material. A cavity containing a gel is defined between the lower handle portion and the upper handle portion.

19 Claims, 2 Drawing Sheets

(51) Int. Cl.
*B26B 3/00* (2006.01)
*B26B 3/02* (2006.01)

(58) Field of Classification Search
USPC ..... 30/340, 342–344
See application file for complete search history.

(56) References Cited

U.S. PATENT DOCUMENTS 4,712,304 A 12/1987 Sanelli
4,825,552 A * 5/1989 Bendickson ..... B25G 1/10 16/DIG. 12
4,869,011 A 9/1989 Whiting et al.
5,023,996 A * 6/1991 Pape ..... B23D 51/01 30/125
5,495,673 A * 3/1996 Gardiner ..... B26B 11/00 30/155
5,528,834 A * 6/1996 Seber ..... B25G 1/102 30/340
5,661,908 A * 9/1997 Chen ..... B23D 51/01 30/125
5,694,692 A * 12/1997 Reinschreiber ..... B26B 1/042 30/155
5,740,586 A * 4/1998 Gomas ..... B25G 1/10 16/430
5,964,009 A * 10/1999 Hoepfl ..... B25G 1/105 16/430
6,070,329 A * 6/2000 Gibbs ..... B26B 1/10 30/340
6,105,255 A * 8/2000 Cheng ..... B26B 1/044 30/155
6,192,589 B1 * 2/2001 Martone ..... B26B 5/001 30/125
6,270,134 B1 * 8/2001 Lin ..... B25B 7/00 16/422
6,276,063 B1 * 8/2001 Chen ..... B26B 1/046 30/155
6,446,341 B1 * 9/2002 Wang ..... B26B 1/046 30/123
6,453,563 B1 9/2002 Farland
6,460,256 B2 * 10/2002 Peppel ..... B25G 1/102 30/340
6,502,314 B1 * 1/2003 McCatty ..... B25G 1/102 16/430
6,591,456 B2 * 7/2003 DeLuca ..... A47C 7/02 16/110.1
6,701,624 B1 * 3/2004 White ..... B26B 3/00 30/295
6,763,747 B1 * 7/2004 Gierer ..... A61K 31/40 16/110.1
6,959,469 B2 11/2005 Blauer et al.
6,968,599 B2 11/2005 Blauer et al.
7,051,441 B2 * 5/2006 Carter, III ..... B26B 1/044 30/160
7,093,367 B1 * 8/2006 Huang ..... B23D 51/01 30/161
7,152,511 B2 * 12/2006 Fen ..... B25G 1/00 16/111.1
7,204,957 B2 4/2007 Tozer
7,234,205 B2 6/2007 Blauer et al.
7,325,312 B1 * 2/2008 Janich ..... B26B 1/048 30/153
7,346,988 B2 * 3/2008 Gringer ..... B26B 5/00 30/151
7,363,685 B2 * 4/2008 Walker ..... B25F 5/006 16/110.1
7,634,839 B2 12/2009 Blauer et al.
7,647,701 B1 * 1/2010 Mollick ..... B26B 1/04 30/155
7,856,910 B2 * 12/2010 Kwok ..... B26B 3/00 16/111.1
7,996,961 B2 8/2011 Blauer et al.
8,499,461 B1 * 8/2013 Mollick ..... B26B 1/046 30/160
8,615,888 B2 * 12/2013 Catalano ..... B25G 1/102 30/151
8,701,294 B2 4/2014 Bruce et al.
8,707,564 B2 * 4/2014 Burch ..... B23D 51/01 30/155
8,839,524 B2 9/2014 Owens
8,844,099 B2 * 9/2014 Puig ..... B25G 1/102 16/422
8,938,883 B2 * 1/2015 Gringer ..... B26B 1/048 30/155
9,050,062 B1 * 6/2015 Gauthier ..... B25G 1/10
9,056,391 B1 * 6/2015 Wu ..... B25B 23/141
9,168,648 B2 * 10/2015 Lombardi ..... B25G 1/02
9,259,845 B2 * 2/2016 Gringer ..... B26B 5/005
9,492,916 B2 * 11/2016 Snyder ..... B25G 1/08
9,815,213 B2 * 11/2017 Duey ..... B26B 1/046
9,878,455 B1 * 1/2018 Perez ..... B26B 1/00
2003/0024543 A1 * 2/2003 Wolf ..... B26B 13/20 132/212
2003/0123917 A1 7/2003 Willat et al.
2003/0221323 A1 * 12/2003 DeAsis ..... B25G 3/32 30/329
2005/0155186 A1 7/2005 McGuyer et al.
2006/0037176 A1 2/2006 McGuyer et al.
2006/0236522 A1 * 10/2006 Lin ..... B21D 53/70 29/527.2
2007/0074401 A1 * 4/2007 Myers ..... B25G 1/00 30/142
2008/0083118 A1 * 4/2008 Steigerwalt ..... B26B 1/02 30/160
2009/0007434 A1 1/2009 Kwok
2009/0126199 A1 * 5/2009 Hampton ..... B24D 15/08 30/138
2009/0271951 A1 11/2009 Hao
2011/0061249 A1 * 3/2011 Ma ..... A01G 3/02 30/520
2013/0104403 A1 5/2013 Stokes
2013/0233863 A1 9/2013 Lapine
2013/0298411 A1 * 11/2013 Miyawaki ..... B25G 1/102 30/340
2014/0259696 A1 9/2014 Clark
2015/0026987 A1 1/2015 Chiang
2016/0256994 A1 * 9/2016 Kerulis ..... B26B 3/02
2017/0136617 A1 * 5/2017 Lucas, Jr. ..... B25G 1/06

FOREIGN PATENT DOCUMENTS

GB 2455147 A 6/2009
WO WO 1988/010180 A1 12/1988
WO WO 2003/018144 A1 3/2003
WO WO 2004/093593 A2 11/2004
WO WO 2010/138752 A1 12/2010
WO WO 2011/032185 A2 3/2011
WO WO 2016/144428 A1 9/2016

* cited by examiner

RESILIENT CUTLERY HANDLE

CROSS-REFERENCE TO RELATED APPLICATIONS

This application claims priority from U.S. Provisional Application No. 62/129,599 filed on Mar. 6, 2015, which is incorporated herein by reference.

FIELD OF THE INVENTION

The present invention relates generally to a cutlery handle for a cutlery implement, and more particularly to a resilient handle for a cutlery implement.

SUMMARY

According to the present invention, a cutlery implement having a blade and resilient handle is provided. The blade has a proximal end, an opposed distal end, a cutting edge and a spine. The spine is disposed on a top side of the blade portion and generally opposed to the cutting edge. The cutlery implement also includes a handle coupled to the blade proximate the distal end of the blade. The handle includes an upper handle portion and a lower handle portion. The upper handle portion is disposed at or near the spine of the blade, and the lower handle portion is coupled to the upper handle portion. Either the upper handle portion or the lower handle is formed from a resilient polymer material, and the other is formed of a generally rigid material. A cavity containing a gel is defined between the lower handle portion and the upper handle portion.

A cutlery implement is also disclosed wherein the implement includes a blade and a handle. The blade has a proximal end, an opposed distal end, a cutting edge and a spine. The spine is disposed on a top side of the blade portion and generally opposed to the cutting edge. The handle is coupled to the blade at or near the distal end of the blade. The handle includes an upper handle portion, a middle assembly and a lower handle portion. The upper handle portion is disposed at or near the spine of the blade. At least a portion of either or both of the upper handle portion or the lower handle is formed from a resilient polymer material, and at least a portion the other of the upper handle portion and the lower handle is formed of a generally rigid material. The middle assembly is disposed between the upper handle portion and the lower handle portion. The middle assembly includes an upper frame disposed proximate an inner surface of the upper handle, an inside frame, a gasket disposed between the upper frame and the inside frame, and a handle core. A cavity containing gel is defined between an outer surface of the handle core and an inner surface of the lower handle portion.

A method of assembling a cutlery implement is also provided. The method includes providing a blade having a proximal end, an opposed distal end, a cutting edge and a spine, wherein the spine is disposed on a top side of the blade portion and generally opposed to the cutting edge. The method also includes the step of assembling a handle comprising an upper handle portion formed of a generally rigid material, a lower handle portion formed from a resilient polymer material, and a middle assembly. The middle assembly has an upper frame, an inside frame and a gasket disposed between the upper frame and the inside frame. A cavity is defined between the lower handle portion and the middle assembly. A gel is injected into the cavity. The handle is attached at or near the proximal end of the blade.

Other features and advantages of the invention will be apparent from the following specification taken in conjunction with the following drawings.

BRIEF DESCRIPTION OF THE DRAWINGS

The figures herein are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

Figure 1:
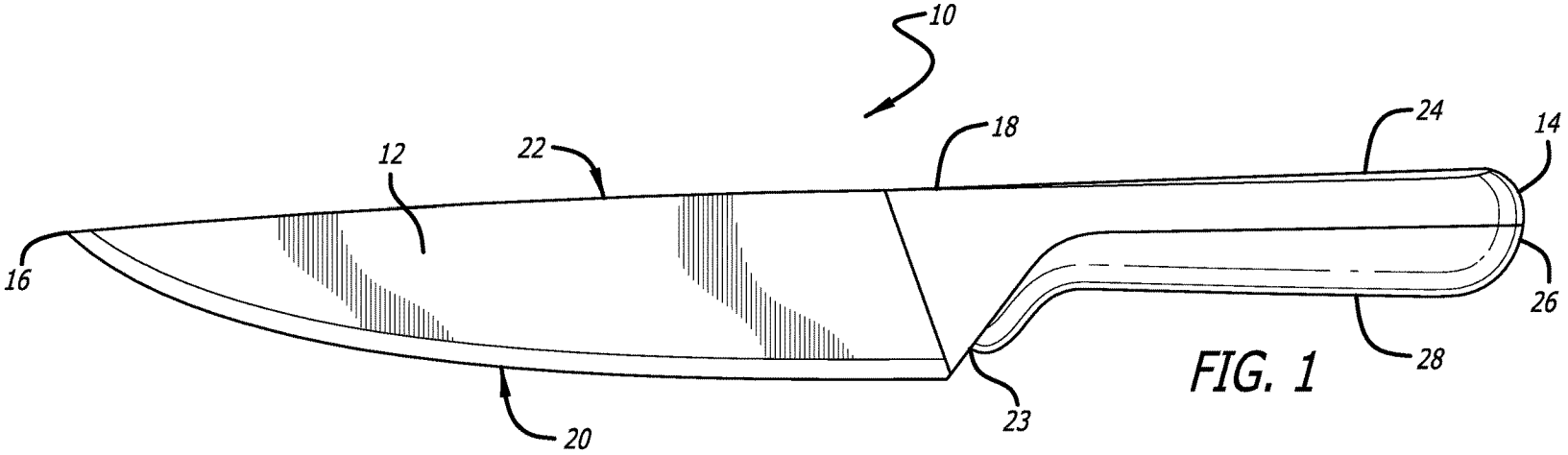
FIG. 1 is a side view of a cutlery implement according to the present invention.
Figure 2:
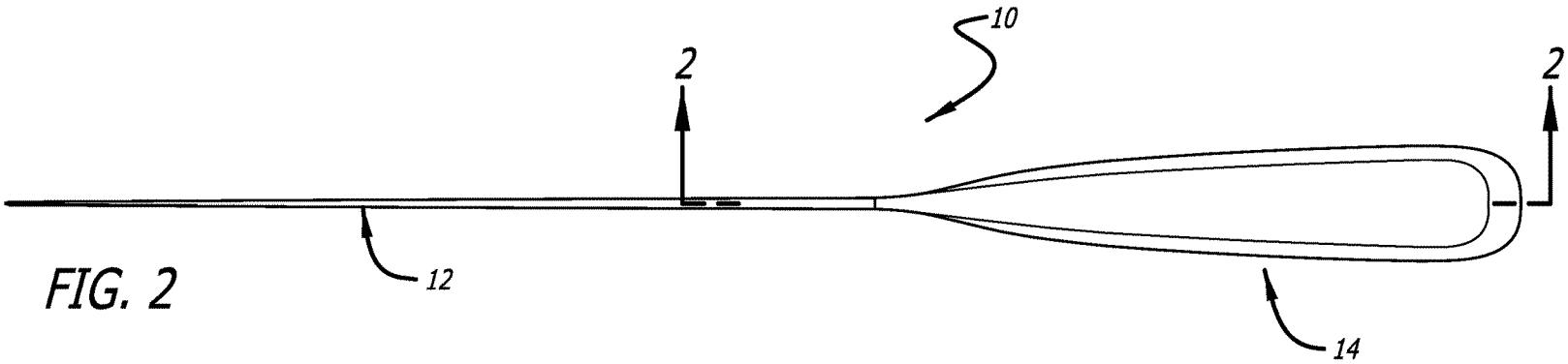
FIG. 2 is a top view of the cutlery implement shown in FIG. 1.
Figure 3:
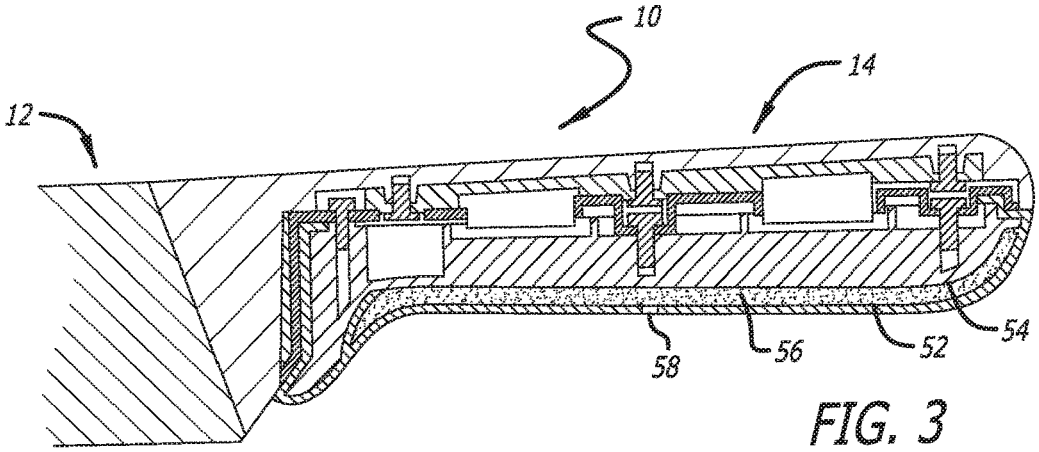
FIG. 3 is a cross-sectional view of the cutlery implement shown in FIG. 2 taken along the line 2-2.

The components in the drawings are not necessarily to scale, emphasis instead being placed upon clearly illustrating the principles of the present invention.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Disclosed herein are various embodiments of a cutlery implement 10 that includes a resilient handle assembly and methods for assembling the same. As shown in FIGS. 1-4, the cutlery implement 10 includes a blade 12 and a handle assembly 14. Although the cutlery implement 10 shown in FIGS. 1-4 is a chef's knife, it will be understood to those of ordinary skill in the art that the principles disclosed herein may be applied to other cutlery implements. For example, the resilient handle assembly 14 may be used in connection with cleavers, santoku, pairing knives, fillet knives, slicing knives, steak knives, boning knives and bread knives and any other kitchen knives. As shown in FIG. 1, the blade 12 has a proximal end 16 (i.e., the tip), an opposed distal end 18, a cutting edge and a spine. The cutting edge can generally run from the proximal end 16 of the knife to a heel that is located at the distal end 18 of the blade 12. The spine generally extends along the top side of the blade 12 and generally opposite the cutting edge.

The handle assembly 14 includes an upper handle portion 24, a middle assembly 26 and a lower handle portion 28. The upper handle portion 24 is disposed at or near the spine of the blade 12. At least a portion of either the upper handle portion 24 or the lower handle is formed from a resilient polymer material, and at least a portion of the other of the upper handle portion 24 and the lower handle portion 28 is formed of a generally rigid material. In one embodiment of the invention shown in FIGS. 1-4, the upper handle portion 24 is formed substantially of a rigid material, and the lower handle portion 28 is formed substantially of a resilient polymer material. It will be understood that the rigid material may be stainless steel, ceramic, a polymer or polymer composite, wood or any other rigid or semi-rigid material suitable for use in cutlery implements.

The handle assembly 14 is coupled to the blade 12 at or near the distal end 18 of the blade 12. In one embodiment, the upper handle portion 24 is attached to the distal end 18 of the blade 12 by a welded connection. It is contemplated, however, that the upper handle portion 24 can be integrally formed with the blade 12.

The middle assembly 26 is disposed between the upper handle portion 24 and the lower handle portion 28. The middle assembly 26 includes an upper frame 30, an inside frame 32, a gasket 34 and a handle core 36. According to one preferred embodiment, the upper frame 30 and inside frame 32 are each formed from acrylonitrile butadiene styrene (ABS) and the gasket 34 is formed from a silicone material. However, it will be understood that the upper frame 30 and inside frame 32 may be formed from any suitable material including, for example, those polymer materials exhibiting high impact resistance, toughness and heat resistance.

Figure 4:
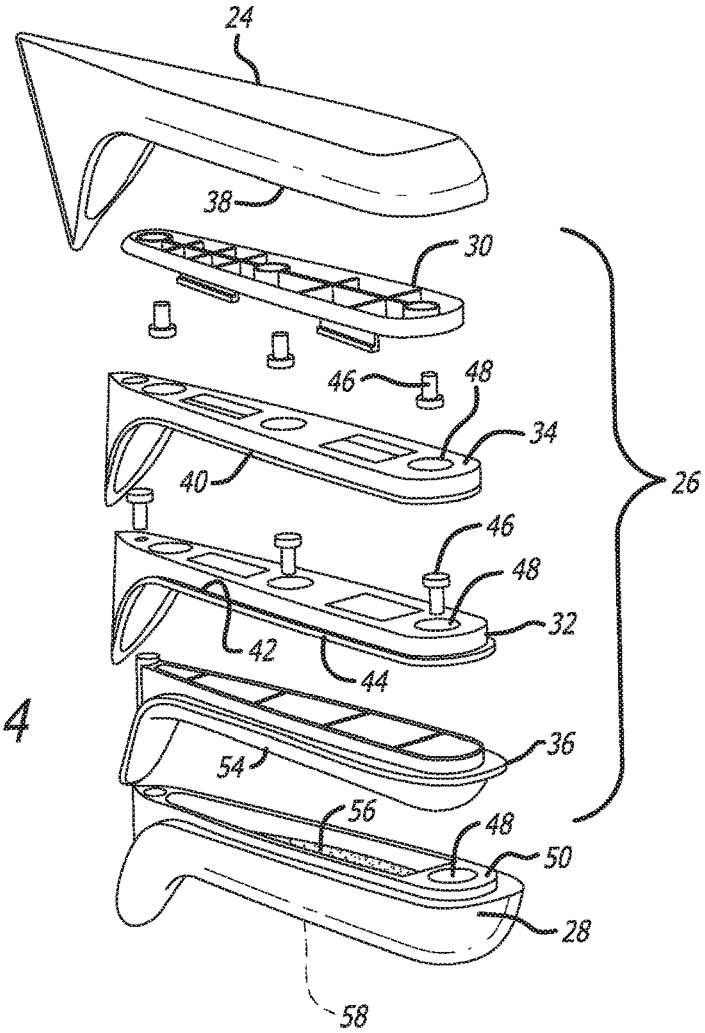
FIG. 4 is an exploded rear perspective view of the cutlery implement shown in FIG. 1.

As shown in FIG. 4, the upper frame 30 is disposed proximate an inner surface 38 of the upper handle portion 24. The gasket 34 is disposed between the upper frame 30 and the inside frame 32. The handle core 36 is disposed below the inside frame 32 and cooperates. In one embodiment, the upper frame 30 of the middle assembly 26 is coupled to the inner surface 38 of the upper handle portion 24 of the handle assembly 14 by a plurality of fasteners 46. Similarly, the inside frame 32 of the middle assembly 26 is coupled to the handle core 36 by fasteners 46. The gasket 34 is disposed between the upper frame 30 and the inside frame 32 and can include an overhang 40 that is friction fit between an inset ledge 42 of the inside frame 32 and an outer ledge 44 of the inside frame 32. It is contemplated that the gasket 34 can be coupled between the upper frame 30 and inside frame 32 by other suitable mechanisms, including, for example, an adhesive, fastener or restrictive o-ring.

As shown in FIG. 4, the handle core 36 is positioned between the inside frame 32 and the lower handle portion. In one embodiment fasteners 46 extend through apertures 48 in the inside frame 32 and the handle core 36, and are received in a boss in apertures 48 of the lower handle portion 28. However, it will be understood that these components may be assembled using other suitable connection methods and mechanisms.

Once assembled, a cavity 52 is defined between an outer surface 54 of the handle core 36 and an inner surface 56 of the lower handle portion 28. The cavity 52 contains a gel material, preferably a silicone polymer. However, the material contained within the cavity 52 may alternatively be any material that creates a gripping surface along at least a portion of the lower handle portion that has a "memory" effect such that it springs back to its original form through reversible compression. Alternatively, the viscosity of the gel may be such that the lower handle portion maintains the form as of the time of gripping. According to one embodiment, the handle assembly 14 includes at least one injection aperture 58 in fluid communication with the cavity 52. The gel can be injected into the cavity 52 through the aperture 58 and subsequently sealed inside.

In another embodiment an elastomer is injection molded onto the middle assembly 26. The elastomer is then covered by an outer skin formed from a more durable elastomer. According to that embodiment, the elastomer creates the "memory" effect such that it springs back to its original form through reversible compression or has a viscoelasticity that causes it to maintain the form as of the time of gripping.

A method of assembling a cutlery implement 10 is also provided. The method includes providing a blade 12 having a proximal end 16, an opposed distal end 18, a cutting edge and a spine, wherein the spine is disposed on a top side of the blade 12 and generally opposed to the cutting edge. The method also includes the step of assembling a handle assembly 14 comprising of an upper handle portion 24 formed of a generally rigid material, a lower handle portion 28 formed from a resilient polymer material, and a middle assembly 26. The middle assembly 26 has an upper frame 30, an inside frame 32 and a gasket 34 disposed between the upper frame 30 and the inside frame 32. A cavity 52 is defined between the lower handle portion and the middle assembly 26. A gel is injected into the cavity 52. The handle assembly 14 is attached at or near the distal end 18 of the blade 12.

According to one embodiment of the method, the handle assembly 14, or the upper handle portion 24, is attached to the blade 12 prior to injecting gel into the cavity 52. However, it will be understood that the steps attaching the handle assembly 14 to the blade 12 is not constrained to any particular order of operation. Accordingly, it is also contemplated that the handle assembly 14 (or the upper handle portion 24) can be attached to the blade 12 after injecting gel into the cavity 52. It will also be understood that the handle assembly 14 can be attached to the blade 12 by a welding connection, fasteners or any other method suitable for attaching the respective materials from which the handle assembly 14 and blade 12 are constructed one to the other.

The disclosed apparatus and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The apparatus and methods illustratively disclosed herein may suitably be practiced in the absence of any element that is not specifically disclosed herein and/or any optional element disclosed herein.

While methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The invention claimed is:

1. A cutlery implement comprising:

a blade having a proximal end and an opposed distal end, the blade further having a cutting edge and a spine, the spine being disposed on a top side of the blade portion and generally opposed to the cutting edge;

a handle coupled to the blade proximate the distal end of the blade, the handle comprising:

an upper handle portion being coupled to the spine of the blade so that the handle remains stationary relative to the blade, and a lower handle portion coupled to the upper handle portion, wherein one of either the upper handle portion and the lower handle portion is formed from a resilient polymer material, and the other of the upper handle portion and the lower handle portion is formed of a generally rigid material;

a cavity defined between the lower handle portion and the upper handle portion, and a handle core, wherein the cavity is defined between an outer surface of the handle core and an inner surface of the lower handle portion, and wherein the cavity contains a gel.

2. The cutlery implement of claim 1, further comprising an injection aperture disposed in the handle, the injection aperture being in fluid communication with the cavity.

3. The cutlery implement of claim 1, wherein the upper handle portion is integrally formed with the blade.

4. The cutlery implement of claim 1, wherein the upper handle portion is coupled to the blade by a welded connection.

5. The cutlery implement of claim 1, wherein the resilient polymer material is silicone.

6. The cutlery implement of claim 1, wherein the gel contained in the cavity is a silicone gel.

7. The cutlery implement of claim 1, wherein the upper handle portion is formed from stainless steel and the lower handle portion is formed from a resilient polymer material.

8. A cutlery implement comprising:

a blade having a proximal end and an opposed distal end, the blade further having a cutting edge and a spine, the spine being disposed on a top side of the blade and generally opposed to the cutting edge;

a handle coupled to the blade proximate the distal end of the blade, the handle comprising:

an upper handle portion being coupled to the spine of the blade so that the handle remains stationary relative to the blade, and a lower handle portion, wherein a portion of one of either the upper handle portion and the lower handle portion is formed from a resilient polymer material, and a portion the other of the upper handle portion and the lower handle portion is formed of a generally rigid material;

a middle assembly disposed between the upper handle portion and the lower handle portion, the middle assembly comprising: an upper frame, a gasket, an inside frame, and a handle core; and wherein a cavity is defined between an outer surface of the handle core and an inner surface of the lower handle portion, and wherein the cavity contains a gel.

9. The cutlery implement of claim 8, further comprising an injection aperture disposed in the handle, the injection aperture being in fluid communication with the cavity.

10. The cutlery implement of claim 8, wherein the middle assembly is comprised of an upper frame disposed proximate an inner surface of the upper handle, an inside frame, a gasket disposed between the upper frame and the inside frame and a handle core, wherein the cavity is defined between an outer surface of the handle core and an inner surface of the lower handle portion.

11. The cutlery implement of claim 8, wherein the entire upper handle portion is formed of a generally rigid material.

12. The cutlery implement of claim 8, wherein the entire lower handle portion is formed of a resilient polymer material.

13. The cutlery implement of claim 8, wherein the upper handle portion is formed from stainless steel and the lower handle portion is formed from a resilient polymer material.

14. The cutlery implement of claim 8, wherein the resilient polymer material is silicone.

15. The cutlery implement of claim 8, wherein a gasket of the middle assembly is formed from silicone.

16. The cutlery implement of claim 8, wherein the upper handle portion is integrally formed with the blade.

17. The cutlery implement of claim 8, wherein the upper handle portion is coupled to the blade by a welded connection.

18. The cutlery implement of claim 8, wherein the gel contained in the cavity is a silicone gel.

19. A cutlery implement comprising:

a blade having a proximal end and an opposed distal end, the blade further having a cutting edge and a spine, the spine being disposed on a top side of the blade portion and generally opposed to the cutting edge;

a handle coupled to the blade proximate the distal end of the blade, the handle comprising:

an upper handle portion being coupled to the spine of the blade so that the handle remains stationary relative to the blade, and a lower handle portion coupled to the upper handle portion, wherein one of either the upper handle portion and the lower handle portion is formed from a resilient polymer material, and the other of the upper handle portion and the lower handle portion is formed of a generally rigid material;

a cavity defined between the lower handle portion and the upper handle portion;

a handle core, wherein the cavity is defined between an outer surface of the handle core and an inner surface of the lower handle portion and wherein the cavity contains a gel; and an injection aperture disposed in the handle, the injection aperture being in fluid communication with the cavity.

* * * * *